US006351623B1

(12) United States Patent
Thayer et al.

(10) Patent No.: US 6,351,623 B1
(45) Date of Patent: Feb. 26, 2002

(54) TONER DISPENSING APPARATUS EMPLOYING A TRAVELING WAVE TRANSPORT GRID

(75) Inventors: Bruce E. Thayer, Webster; Michael D. Thompson, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,925

(22) Filed: Nov. 27, 2000

(51) Int. Cl.[7] ..... G03G 15/08
(52) U.S. Cl. ..... 399/258; 399/260; 399/261
(58) Field of Search ..... 399/253, 258, 399/260, 261, 263

(56) References Cited

U.S. PATENT DOCUMENTS 4,647,179 A 3/1987 Schmidlin ..... 355/3 DD
5,541,716 A 7/1996 Schmidlin ..... 355/261
5,619,312 A * 4/1997 Hatano et al. ..... 399/61
6,272,296 B1 * 8/2001 Gartstein ..... 399/55

* cited by examiner

*Primary Examiner*—Quana M. Grainger
(74) *Attorney, Agent, or Firm*—Lloyd F. Bean II

(57) ABSTRACT

A novel toner dispensing apparatus without any moving parts is provided. The toner dispensing apparatus, includes a toner hopper for containing a quantity of finely divided toner, said hopper having an elongated opening formed by the cooperation of the walls thereof through which toner is capable of being dispensed from said hopper, and a dispensing electrode array on a surface of one of said wall, for transporting toner in a direction of movement toward said an elongated opening formed at a dispensing rate; and a wave generator for generating a travel wave pattern for transporting toner in said direction of movement.

4 Claims, 3 Drawing Sheets

TONER DISPENSING APPARATUS EMPLOYING A TRAVELING WAVE TRANSPORT GRID

BACKGROUND OF THE INVENTION

Cross reference is made to the following application filed concurrently herewith: application Ser. No. 09/723,084 entitled "Blade Cleaning System" by Bruce E. Thayer et al.

The present invention is directed to toner dispensing apparatus. More specifically, the present invention is directed to toner dispensing apparatus for a developer station in an automatic electrostatographic machine.

In the act of xerography a photoconductive insulating plate supported by conductive backing is first uniformly charged, and then exposed to a light and shadow image to be reproduced. Under the influence of the light image the photoconductive layer becomes conductive and the charge is selectively dissipated in the light image areas through the photoconductive plate to the conductive backing leaving an electrostatic latent image on the photoconductive plate. The electrostatic latent image which is not visible to the eye is made visible by contacting the photoconductive plate bearing the image with a finely divided pigmented resin base material commonly referred to in the art as toner which is first charged to an appropriate potential such that the toner will adhere to the photoconductive plate in the image or charged areas for a charged area development system.

Typically the developer is transferred from the photoconductive plate to a final support material such as paper and fixed such as by heat fusing thereto to form a permanent record of the original.

In an automatic reproducing device, the toner material is consumed in the development process and it must be periodically replaced within the development system in order to sustain continuous operation of the machine. Various techniques have been used in the past to replenish the toner supply. Initially new toner material was added directly from supply bottles or containers to the dispensing apparatus by pouring.

Attempts have been made to provide a separate toner hopper with a dispensing mechanism for adding the toner from the hopper to the developer apparatus in the automatic xerographic reproducing machines on a regular or as needed basis.

The toner dispensing mechanism has been widely used. Some dispensing mechanisms employ an open celled foam dispensing roll, the toner is loaded into the cells during that portion of the foam roll's travel in the toner hopper. As the foam roll is rotated past the two sets of lobes, the toner is retained under pressure within the open cells of the foam roll. As the foam roll is rotated past the exit lobe the release of the pressure on the open cells provides a spring thrust to the toner within the cells so that a force in addition to that of gravity expels the toner out of the cells into the developer chamber.

While this technique is generally satisfactory, it suffers from certain drawbacks. With continued use and particularly with long term use, the open celled foam roll gradually becomes impregnated with toner often times with the toner impregnation extending all the way to the foam roll shaft. As the foam roll becomes increasingly impregnated, several things happen to the operational properties under which the foam dispensing roll operates. Initially, as the toner impregnation commences the foam tends to lose flexibility or resiliency and therefore lacks that extra kick to expel toner from the open cells of the foam to the developer chamber. The toner not expelled from the cells contributes to the further buildup or impaction of toner in the open cells of the foam roll.

This gradual buildup also contributes to non-uniform and generally decreasing toner dispensing rates until it reaches a point where the foam roll is fully impregnated with toner and the dispensing rate falls off drastically leading to nonuniform image density from copy to copy. In addition, as the degree of toner impregnation or compaction of the foam roll increases, the outside diameter of the foam roll decreases to a point where the seal between the roll and the hopper lobes is lost and undesirable large amounts of toner may pass to the developer chamber. Furthermore, as the foam roll becomes impregnated with toner the torque required to drive the roll increases, increasing the load on the motor driving the shaft and/or increasing the load on the shaft. In this instance it is possible for the shaft to fracture or separate from the foam and/or the motor to burn out. In each of the above instances, the operational life of the dispensing roll is substantially reduced and it must be replaced at unscheduled times giving rise to increased service cost for the reproducing machine user.

SUMMARY OF THE INVENTION

It is an object of the present invention to provide a novel toner dispensing apparatus without any moving parts.

There is provided a toner dispensing apparatus for dispensing toner to a station, including a toner hopper for containing a quantity of finely divided toner, said hopper having an elongated opening formed by the cooperation of the walls thereof through which toner is capable of being dispensed from said hopper, and a dispensing electrode array on a surface of one of said walls, for transporting toner in a direction of movement toward said elongated opening at a dispensing rate; and a wave generator for generating a traveling wave pattern for transporting toner in said direction of movement.

For a better understanding of the present invention as well as other objects and further features thereof, reference is made to the following description of the invention to be read in conjunction with the accompanying drawings wherein:

DESCRIPTION OF PREFERRED EMBODIMENT

Figure 1:
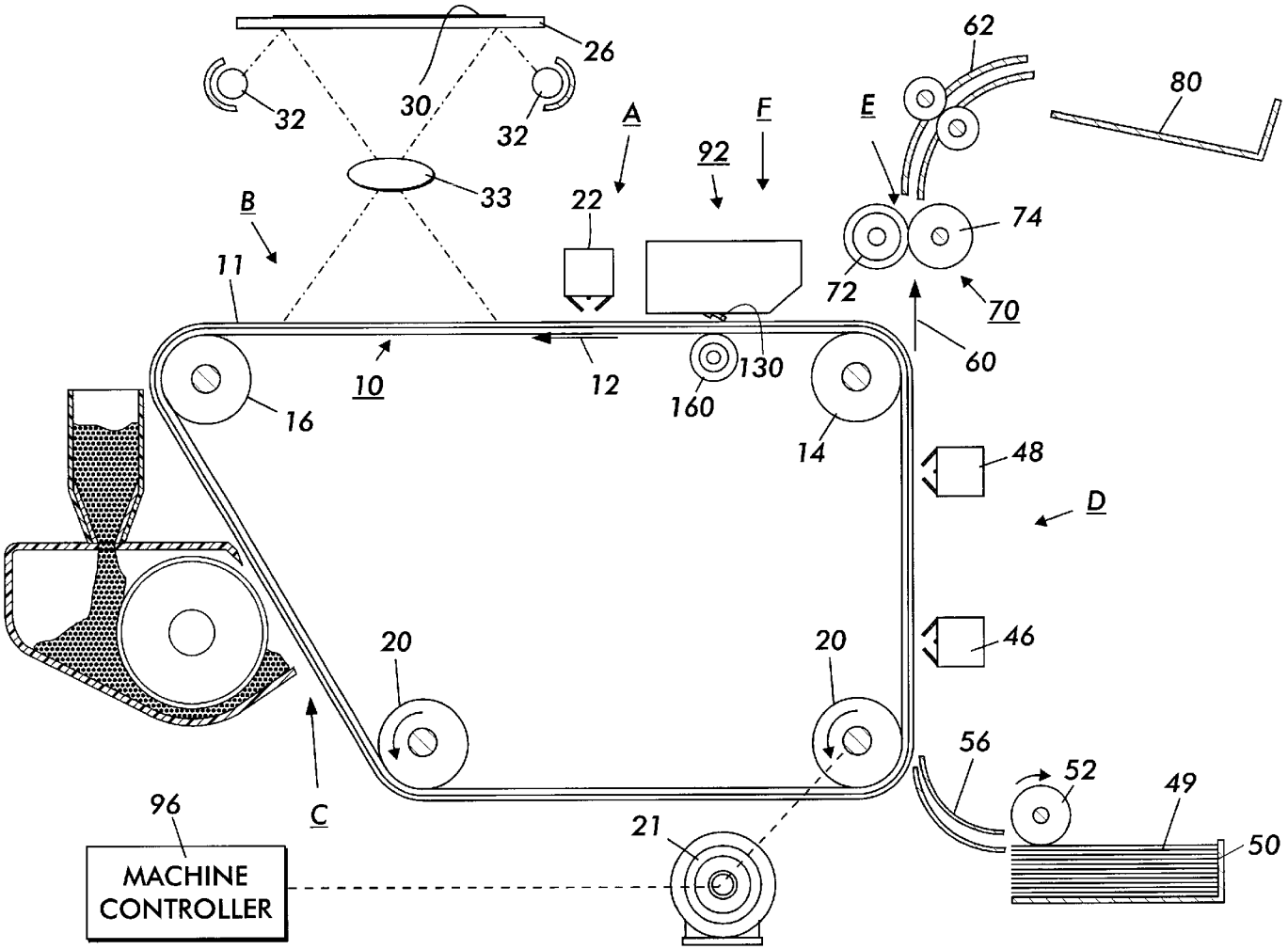
FIG. 1 is a schematic representation of an automatic xerographic reproducing apparatus using the toner dispensing apparatus of the present invention.

The invention will now be described by reference to a preferred embodiment of the reproducing apparatus.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of belt 10 sequentially through the various processing stations disposed about the path of movement thereof. Belt 10 is entrained about a stripping roller 14, a tension roller 16, and a drive roller 20. Drive roller 20 is coupled to a motor 21 by suitable means such as a belt drive. Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

With continued reference to FIG. 1, initially a portion of belt 10 passes through charging station A. At charging station A, a corona device 22 charges a portion of the photoreceptor belt 10 to a relatively high, substantially uniform potential, either positive or negative. At exposure station B, an original document is positioned face down on a transparent platen 30 for illumination with flash lamps 32. Light rays reflected from the original document are reflected through a lens 33 and projected onto the charged of the photoreceptor belt 10 to selectively dissipate the charge thereon. This records an electrostatic latent image on the belt which corresponds to the informational area contained within the original document.

Alternatively, a laser may be provided to imagewise discharge the photoreceptor in accordance with stored electronic information. Thereafter, belt 10 advances the electrostatic latent image to development station C. At development station C the developer housing 19 contacts photoreceptor belt 10 for the purpose of developing the electrostatic latent image. Developer housing 19 supports a developing system such as a magnetic brush roll 43, shown in FIG. 2, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If more than one color of developer material is required, additional developer housings may be added. The photoreceptor belt 10 then advances the developed latent image to transfer station D.

At transfer station D, a sheet of support material such as paper copy sheets is advanced into contact with the developed latent images on belt 10. A corona generating device 46 charges the copy sheet to the proper potential so that it becomes tacked to the photoreceptor belt 10 and the toner powder image is attracted from the photoreceptor belt 10 to the sheet.

After transfer, a corona generator 48 charges the copy sheet to an opposite polarity to detach the copy sheet from belt 10, whereupon the sheet is stripped from belt 10 at stripping roller 14. Sheets of support material 49 are advanced to transfer station D from supply tray 50. Sheets are fed from tray 50 with sheet feeder 52, and advanced to transfer station D along conveyor 56. After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72.

In this manner, the toner powder image is permanently affixed to the sheet, and such sheets are directed via a shoot 62 to an output 80 or finisher. Residual particles, remaining on the photoreceptor belt 10 after each copy is made, may be removed at cleaning station F. The cleaning apparatus of the present invention is represented by the reference numeral 92. Removed residual particles may also be stored for disposal. A machine controller 96 is preferably a known programmable controller or combination of controllers, which conventionally control all the machine steps and functions described above.

The controller 96 is responsive to a variety of sensing devices to enhance control of the machine, and also provides connection of diagnostic operations to a user interface (not shown) where required.

As thus described, a reproduction machine in accordance with the present invention may be any of several well-known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein.

Figure 2:
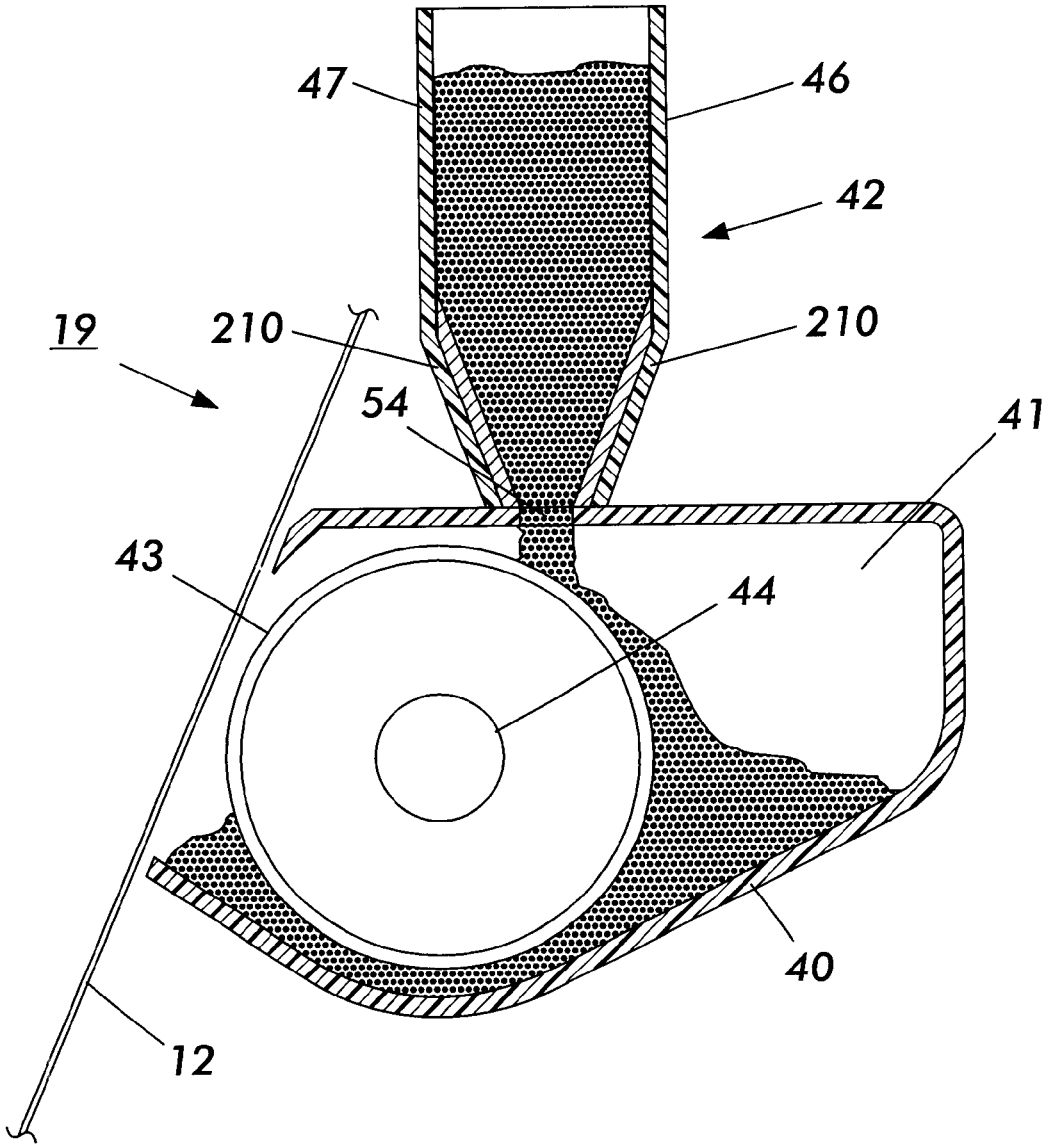
FIG. 2 is an enlarged schematic cross sectional view showing the developer assembly and the toner dispenser of the present invention.
Figure 3:
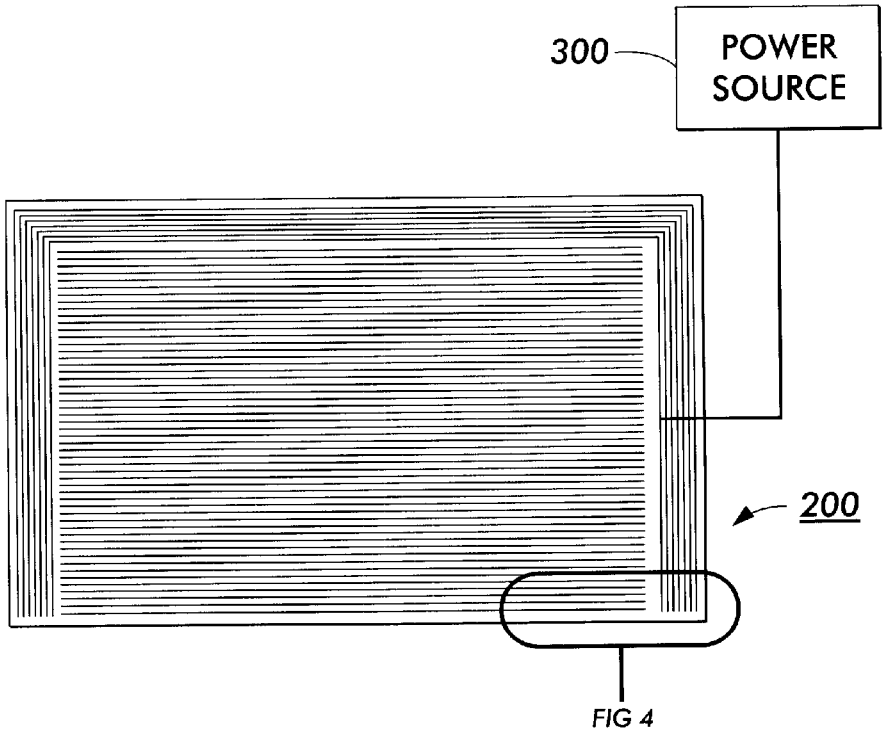
FIGS. 3 and 4 are top view of a portion of the flexible transport grid of the present invention.
Figure 4:
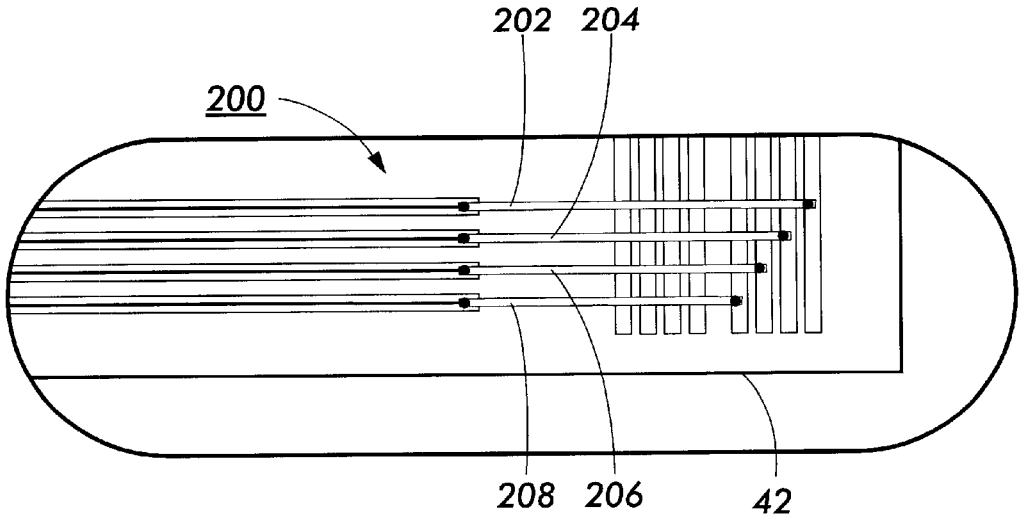

Referring now particularly to FIGS. 2–4 the developing apparatus including the toner dispenser of the present invention will be described in greater detail. The developing station 19 includes a developer chamber 40 housing the developer mechanism; a developer cross mixer 41 and a toner dispenser 42. Typically, the developer mechanism could include a magnetic brush development roll 43 which is rotatably driven by means not shown about shaft 44. In such a system, a developer mix having coarse ferromagnetic carrier granules and toner colorant particles could be used.

The magnetic brush developer roll is in developing engagement with the photoconductive belt 12 carrying the electrostatic latent image. The developer cross mixer 41 ensures that the toner and carrier in the developer are more uniformly mixed and present a more uniform mixture to the electrostatic latent image to be developed.

As illustrated in FIG. 2, the toner dispenser includes a hopper 42 constructed of two substantially parallel end walls (not shown) and two side walls 46, 47 that are integrally connected at their comers to form an enclosed receptacle. The top of the hopper 42 is provided with an opening covered by a lid 53 through which new toner material may be added directly to the toner dispenser to replenish the supply in the developer housing. The bottom portions of the two side walls 46, 47 cooperate with the end walls to form an elongated opening 54 in the bottom of the container. The inclined surfaces of the side walls 46 and 47 function to direct particulate material supported within the container downwardly toward the elongated opening 54.

Side walls 46, 47 and the end walls have a flexible circuit board 210 extending the length thereof. Flexible circuit board 210 has finely spaced electrode array 200 thereon as shown in FIGS. 3 and 4. The typical spacing between electrodes is between 75 and 100 microns. The electrode array 200 has a four phase grid structure consisting of electrodes 202, 204, 206 and 208 having a voltage source and a wave generator 300 operatively connected thereto in the manner shown in order to supply the proper wave form in the appropriate electrode. The traveling wave is generated by alternating voltages of three or more phases applied to a linear array of conductors placed about the outer periphery of the conveyor. The force F for moving the toner about the conveyor is equal $QE_t$ where Q is the charge on the toner and $E_t$ is the tangential field supplied by a multi-phase AC voltage applied to the array of conductors.

A concern in the flow of any finely divided particulate or powder out of a hopper is clogging of the exit opening. Especially in hoppers with converging walls, material becomes compressed to form a plug that is capable of withstanding pressure of the material above. This plug bridges the gap between the hopper walls above the exit opening and prevents material flow through the exit opening.

The transport grid when energized causes the toner against the grid to flow towards the elongated opening 54 of the hopper. The toner is moved along the converging walls of the hopper and smooth flow of toner out of the hopper is enabled. No other toner transport aids and no moving parts are required to remove bridged or plugged toner.

If the hopper is designed to bridge, then the toner transport grid can be used to regulate the flow from the hopper, i.e., as a toner dispenser. Toner would flow when the grid was energized and flow could be shut off when the grid is de-energized or the frequency of excitation is changed. The regulation rate is varied by changing the duty cycle during which the traveling wave device is energized or by varying the frequency of the traveling wave.

This transport action at the walls of the hopper allows toner flow out of hoppers even when a toner bridge has formed in the central portion of the hopper. The toner plug in a bridged hopper is removed from the hopper by the "grating" action of the transport grids against the edges of the plug. As toner along the edges of the hopper is removed the plug falls deeper into the hopper where more toner can be removed from the edges.

For example, a square wave could be used with amplitude 200V to 800V at a 10 hz to 200 hz frequency applied to the electrodes with each of four phases differing by $\pi/2$. When toner is needed by the development system, the device can be energized periodically releasing toner from the hopper. The percent of time the grid is energized will be proportional to the amount of toner released from the hopper thereby controlling the dispense rate. The frequency of the traveling wave could also be varied for example from 10 HZ to 500 hz to control the rate of dispense. Depending on the toner used, a given frequency will dispense toner at a different rate with higher dispense rates generally attained with higher frequencies.

While this invention has been described with reference to the structure disclosed herein, it is not confined to the details set forth in this application but is intended to cover modifications and changes as may become apparent to the artisan. It is intended that these and other modifications would come within the scope of the appended claims.

We claim:

1. A toner dispensing apparatus for dispensing toner to a station, comprising:

a toner hopper for containing a quantity of finely divided toner, said hopper having an elongated opening formed by the cooperation of the walls thereof through which toner is capable of being dispensed from said hopper, and a dispensing electrode array on a surface of one of said wall, for transporting toner in a direction of movement toward said an elongated opening formed at a dispensing rate; and a wave generator for generating a travel wave pattern for transporting toner in said direction of movement.

2. The toner dispensing apparatus of claim 1, including means for controlling said wave generator means, for adjusting the dispensing rate thereby metering a uniform load of toner to the station.

3. The toner dispensing apparatus of claim 1 wherein said elongated opening is formed by the cooperation of the side walls and end walls of the hopper and said elongated opening is in the lower portion of said hopper which together form a toner plug to prevent discharge of toner when said wave generator is disable.

4. A hopper for storage and discharge of a finely divided particulate or powder material, comprising:

a hopper containing a quantity of finely divided particulate or powder material having a discharge opening in the lower portion allowing material to flow from said hopper, and an electrode array on the inside surface of the walls forming said hopper, and an electrical wave generator for generating a traveling wave pattern in the electrode array to facilitate discharge of the material from the hopper.

* * * * *